US009666063B2

(12) United States Patent
Modi et al.

(10) Patent No.: US 9,666,063 B2
(45) Date of Patent: May 30, 2017

(54) MOTION SENSOR ADJUSTMENT

(71) Applicant: Google Inc., Mountain View, CA (US)

(72) Inventors: Yash Modi, San Mateo, CA (US); Aveek Ravishekhar Purohit, Mountain View, CA (US); Kenneth Louis Herman, San Jose, CA (US)

(73) Assignee: Google Inc., Mountain View, CA (US)

( * ) Notice: Subject to any disclaimer, the term of this patent is extended or adjusted under 35 U.S.C. 154(b) by 35 days.

(21) Appl. No.: 14/682,587

(22) Filed: Apr. 9, 2015

(65) Prior Publication Data

US 2016/0300479 A1 Oct. 13, 2016

(51) Int. Cl.

| | |
|---|---|
| ***G08B 13/18*** | (2006.01) |
| ***G08B 29/18*** | (2006.01) |
| ***G08B 13/19*** | (2006.01) |
| ***G08B 25/00*** | (2006.01) |
| ***G08B 29/26*** | (2006.01) |

(52) U.S. Cl.
CPC ..... *G08B 29/183* (2013.01); *G08B 13/19* (2013.01); *G08B 25/001* (2013.01); *G08B 29/185* (2013.01); *G08B 29/26* (2013.01)

(58) Field of Classification Search
CPC ..... G08B 29/183; G08B 13/19
See application file for complete search history.

(56) References Cited

U.S. PATENT DOCUMENTS 4,857,912 A 8/1989 Everett, Jr. et al.
5,189,393 A 2/1993 Hu
5,764,143 A 6/1998 Buccola
5,772,326 A * 6/1998 Batko ..... G01K 1/16 236/51
6,188,318 B1 * 2/2001 Katz ..... G08B 13/1645 340/506
6,288,395 B1 9/2001 Kuhnly et al.
6,448,558 B1 9/2002 Greene
6,800,854 B2 10/2004 Pfister et al.
7,176,463 B2 * 2/2007 Eskildsen ..... G08B 13/19 250/342
7,375,630 B2 * 5/2008 Babich ..... G08B 13/19 340/554
7,679,509 B2 * 3/2010 Royer ..... G01S 13/56 340/506

(Continued)

OTHER PUBLICATIONS

Partial European Search Report dated Sep. 22, 2016 as received in Application No. 16164488.5.

*Primary Examiner* — Erin File
(74) *Attorney, Agent, or Firm* — Morris and Kamlay LLP

(57) ABSTRACT

Systems and techniques are provided for motion sensor adjustment. A signal indicating that a moving heat source was detected by a passive infrared sensor may be received. A signal including a current temperature may be received. It may be determined based on the current temperature and at least one previous temperature that an area in proximity to the passive infrared sensor has experienced a temperature change. In response to the determination that the area in proximity to the passive infrared sensor has experienced a temperature change, the signal indicating that a moving heat source was detected by the passive infrared sensor may be disregarded as a false alert and no indication of motion detected may be sent.

24 Claims, 10 Drawing Sheets

(56) References Cited

U.S. PATENT DOCUMENTS 7,761,186 B2 * 7/2010 Keller ..... G05B 15/02 160/5
8,115,203 B2 2/2012 Hu et al.
8,115,641 B1 * 2/2012 Dempsey ..... G08B 21/0492 340/522
8,165,719 B2 * 4/2012 Kinney ..... E06B 7/08 318/266
8,665,330 B2 * 3/2014 Chien ..... G08B 13/19665 348/143
8,681,223 B2 * 3/2014 Howe ..... G06K 9/00771 345/156
9,304,043 B2 * 4/2016 Ayala ..... G01J 5/0025
9,495,860 B2 * 11/2016 Lett ..... G08B 25/001
2003/0102688 A1 6/2003 Bingle et al.
2003/0136908 A1 7/2003 Pfister et al.
2004/0215750 A1 * 10/2004 Stilp ..... G06K 7/0008 709/220
2006/0011843 A1 * 1/2006 Eskildsen ..... G08B 13/19 250/342
2007/0176765 A1 * 8/2007 Babich ..... G08B 13/19 340/522
2008/0218340 A1 * 9/2008 Royer ..... G01S 13/56 340/567
2009/0149973 A1 * 6/2009 Keller ..... G05B 15/02 700/90
2009/0195382 A1 * 8/2009 Hall ..... G08B 13/19613 340/541
2009/0231119 A1 * 9/2009 Cohen ..... G08B 25/14 340/518
2010/0332034 A1 * 12/2010 Bergeson ..... E06B 7/08 700/275
2011/0001812 A1 * 1/2011 Kang ..... G08B 13/00 348/77
2012/0162417 A1 * 6/2012 Chien ..... G08B 13/19665 348/143
2012/0327241 A1 * 12/2012 Howe ..... G06K 9/00771 348/155
2015/0061859 A1 * 3/2015 Matsuoka ..... G08B 27/00 340/501
2015/0084517 A1 * 3/2015 Ayala ..... G01J 5/0025 315/152
2015/0156031 A1 * 6/2015 Fadell ..... H04L 12/2816 700/276
2015/0161882 A1 * 6/2015 Lett ..... G08B 25/001 340/506
2015/0229488 A1 * 8/2015 Averitt ..... H04L 12/2809 455/420
2016/0061472 A1 * 3/2016 Lee ..... F24F 11/006 700/276

* cited by examiner

MOTION SENSOR ADJUSTMENT

BACKGROUND

A smart home environment may include sensors that monitor various aspects of an environment such as a home. Motion sensors may monitor rooms in the home for motion, and may be able to generate an alert when motion is detected in a room in which no motion is expected. Motion sensors may use passive infrared sensors, which may be able to detect heat sources within a room, and detect motion based on the motion of heat sources. Changes in temperature in the room, or the movement of heat source that is not a person, for example due to the HVAC system blowing air onto an object moveable by air, may trigger false alerts from a motion sensor that uses a passive infrared sensor.

BRIEF SUMMARY

According to an embodiment of the disclosed subject matter, a signal indicating that a moving heat source was detected by a passive infrared sensor may be received. A signal including a current temperature may be received. It may be determined based on the current temperature and at least one previous temperature that an area in proximity to the passive infrared sensor has experienced a temperature change. In response to the determination that the area in proximity to the passive infrared sensor has experienced a temperature change, the signal indicating that a moving heat source was detected by the passive infrared sensor may be disregarded as a false alert and no indication of motion detected may be sent.

An adjustment for the passive infrared sensor may be determined based on the disregarding the signal indicating that a moving heat source was detected by a passive infrared sensor as a false alert. The adjustment may be applied to the passive infrared sensor. The adjustment may include a reduction in the sensitivity of the passive infrared heat source to moving heat sources.

A second signal indicating that a moving heat source was detected by passive infrared sensor may be received. A second signal including a current temperature may be received. It may be determined, based on the current temperature and at least one previous temperature that an area in proximity to the passive infrared sensor has not experienced a temperature change. In response to the determination that the area in proximity to the passive infrared sensor has not experienced a temperature change, an indication of motion detected may be sent. The indication of motion detected may be sent to a computing device of a smart home environment.

To determine, based on the current temperature and a previous temperature that an area in proximity to the passive infrared sensor has experienced a temperature change, it may be determined that the temperature in the area in proximity to the passive infrared sensor has fluctuated beyond a threshold amount. The time period begins before the signal indicating a moving heat source was detected by the passive infrared sensor is received and ends after the signal indicating a moving heat source was detected by the passive infrared sensor is received.

A signal indicating that motion was detected by a motion sensor may be received. A status of an HVAC system may be received. It may be determined, using the HVAC status, that a vent of the HVAC system located in an area visible to the motion sensor was operating during the time period in which the motion sensor detected motion. The signal indicating that motion was detected may be ignored as a false alert and an alert may not be generated.

An adjustment to the motion sensor may be determined based on the ignoring of the signal indicating that motion was detected. The adjustment may be sent to the motion sensor. The adjustment may include reducing the sensitivity of a passive infrared sensor of the motion sensor to moving heat sources. It may be determined that the vent is in proximity to a window curtain. It may be determined that the motion detected by the motion sensor occurred in proximity to the vent and a window curtain.

A signal including a current temperature near a motion sensor may be received. A signal including a current temperature near a temperature sensor in the same room as the motion sensor may be received. An adjustment for the motion sensor may be determined based on the current temperature near the motion sensor, past temperatures near the motion sensor, a current temperature near a temperature sensor in the same room as the motion sensor, and a past temperature near a temperature sensor in the same room as the motion sensor. The adjustment may be sent to the motion sensor.

To determine the adjustment, it may be determined that the temperature near the motion sensor varies from the temperature near at least one temperature sensor over a time period. An HVAC status may be received. It may be determined from the HVAC status that the ambient temperature near the motion sensor is higher than the ambient temperature near a temperature sensor over a time period coinciding with a time period when a vent in the room with the motion sensor is operating to convey hot air. It may be determined that the vent is located near the motion sensor. It may be determined that the temperature near the motion sensor is higher than the temperature near at least one temperature sensor over a time period coinciding with at least a part of daylight hours. It may be determined that the motion sensor is located near a window. An alert that the motion sensor is located near a heat source may be transmitted.

According to an embodiment of the disclosed subject matter, a means for receiving a signal indicating that a moving heat source was detected by a passive infrared sensor, a means for receiving a signal including a current temperature, a means for determining, based on the current temperature and at least one previous temperature that an area in proximity to the passive infrared sensor has experienced a temperature change, a means for, in response to the determination that the area in proximity to the passive infrared sensor has experienced a temperature change, disregarding the signal indicating that a moving heat source was detected by the passive infrared sensor as a false alert and not sending an indication of motion detected, a means for determining an adjustment for the passive infrared sensor based on the disregarding the signal indicating that a moving heat source was detected by a passive infrared sensor as a false alert, a means for applying the adjustment to the passive infrared sensor, a means for receiving a second signal indicating that a moving heat source was detected by passive infrared sensor, a means for receiving a second signal including a current temperature, a means for determining, based on the current temperature and a previous temperature that an area in proximity to the passive infrared sensor has not experienced a temperature change, a means for in response to the determination that the area in proximity to the passive infrared sensor has not experienced a temperature change, sending an indication of motion detected, and a means for determining that the temperature in the area in proximity to the passive infrared sensor has fluctuated beyond a threshold amount, are included A means for receiving a signal indicating that motion was detected by a motion sensor, a means for receiving a status of an HVAC system, determining, using the HVAC status, that a vent of the HVAC system located in an area visible to the motion sensor was operating during the time period in which the motion sensor detected motion, a means for ignoring the signal indicating that motion was detected as a false alert and not generating an alert, a means for determining an adjustment to the motion sensor based on the ignoring of the signal indicating that motion was detected, a means for sending the adjustment to the motion sensor, a means for reducing the sensitivity of a passive infrared sensor of the motion sensor to moving heat sources, a means for determining that the vent is in proximity to a window curtain, and a means for determining that the motion detected by the motion sensor occurred in proximity to the vent and a window curtain, are also included.

A means for receiving a signal including a current temperature near a motion sensor, a means for receiving at least one signal including a current temperature near a temperature sensor in the same room as the motion sensor, a means for determining an adjustment for the motion sensor based on the current temperature near the motion sensor, past temperatures near the motion sensor, a current temperature near a temperature sensor in the same room as the motion sensor, and a temperature near a temperature sensor in the same room as the motion sensor, a means for sending the adjustment to the motion sensor, a means for determining that the temperature near the motion sensor varies from the temperature near a temperature sensor over a time period, a means for receiving an HVAC status, a means for determining from the HVAC status that the ambient temperature near the motion sensor is higher than the ambient temperature near a temperature sensor over a time period coinciding with a time period when a vent in the room with the motion sensor is operating to convey hot air, a means for determining that the vent is located near the motion sensor, a means for determining that the temperature near the motion sensor is higher than the temperature near at least one temperature sensor over a time period coinciding with at least a part of daylight hours, a means for determining that the motion sensor is located near a window, and a means for transmitting an alert that the motion sensor is located near a heat source, are also included.

A means for detecting, with a photodiode, a base level of infrared light emitted from an active infrared sensor and arriving at the photodiode, a means for detecting, with the photodiode, a current level of infrared light emitted from the active infrared sensor and arriving at the photodiode, a means for determining that the current detected level of infrared light differs from the detected base level of infrared light, a means for generating an alert in response to the determination that the current detected level of infrared light differs from the base level of infrared light, a means for determining that the current detected level of infrared light is different from the detected base level of infrared light by at least a threshold amount, and a means for determining that the current detected level of infrared light is lower than the detected base level of infrared light, are also included.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
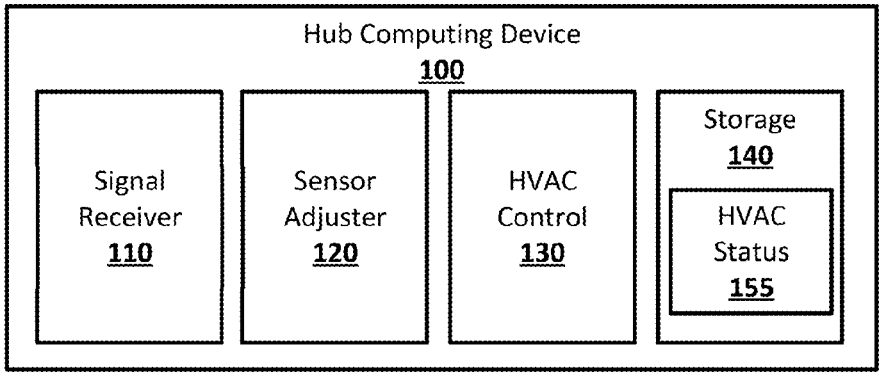
FIG. 1 shows an example system suitable for motion sensor adjustment according to an implementation of the disclosed subject matter.

According to embodiments disclosed herein, motion sensor adjustment may allow for alerts from a motion sensor that uses a passive infrared sensor to be disregarded or not generated when they are caused by changes in the ambient temperature of the room or by an environmental heat source for the room, such as a forced air or radiant heating system. A motion sensor may include a passive infrared sensor, and may also include a temperature sensor, be connected to a temperature sensor, or both. The temperature sensors may monitor the temperature of the room in the vicinity of the temperatures sensors, a heating duct for the room, or a radiant heat source for the room in which the motion sensor can be located. When the passive infrared sensor detects movement of a heat source which would normally cause the motion sensor to trip and trigger an alert, the temperature of the room or the temperature of one or more environmental heaters may as reported by the temperature sensors that can be independent of, part of or connected to the motion sensor may be checked to determine if the temperature is rising or has risen recently. If the reported temperature rose coincident with detection of moving heat source in the room, this may indicate that the passive infrared sensor detected the increase in temperature caused by an environmental heater rather than a person moving the room. The motion sensor may not trip and may not generate an alert. The sensitivity of the passive infrared sensor may also be decreased to account for reported changes in environmental heat sources for the room. This can reduce the likelihood that temperature changes caused by environmental heating would be falsely construed as movements based on data reported by one or more passive infrared detectors. If the temperature did not rise according to the environmental temperature sensors, the motion sensor may send a trip signal, or alert, to a hub computing device. The hub computing device may check the status of the HVAC system to determine if a heating vent in the room was operating (e.g., blowing air) coincident with the detection of a moving heat source in the room. If a vent in the room was operating and the motion was detected near the vent, the alert may be disregarded, as the vent may have caused a warmed object such as a curtain warmed by sunlight to move. The temperature sensors may also be used to adjust the sensitivity of the passive infrared sensor. If temperature sensors in the room with the motion sensor, but at different locations, report colder temperatures than a temperature sensor that is part of, or located near, the motion sensor, than the motion sensor may be located in an area where it is exposed to an external heat source, such as a vent or direct sunlight. The sensitivity of the passive infrared sensor may be adjusted to prevent false alerts based on the ambient temperature near the motion sensor. A user may also be notified that they should move the motion sensor.

A motion sensor may be used to detect motion within a room as part of a smart home environment. The motion sensor may be, for example, a low-power motion sensor, and may use a passive infrared sensor for motion detection. The passive infrared sensor may detect heat, and may report the motion of a heat source within its field of view as the motion of a person of a person within a room. The motion sensor may trip, sending an alert. When a security system in the smart home environment is in an armed state, the alert from the motion sensor may be cause for sending out an alert, sounding an alarm, and notifying occupants of the environment or authorities of an intruder, as the room with the motion sensor should be empty.

Temperature sensors may be placed in the room with the motion sensor. The motion sensor may include a temperature sensor along with the passive infrared sensor, a temperature sensor may co-located with the motion sensor, and other temperature sensors may be located at other points throughout the room. Temperature sensors that are not part of the motion sensor may be connected to the motion sensor or to a hub using any suitable wired or wireless connection. The temperature sensors in the room may sample the ambient temperature of the room at any suitable interval, and may store any number of detected temperature locally, or may store them on any suitable accessible storage device.

The ambient temperature of the room in which the motion sensor is located may fluctuate. For example, the HVAC system may turn on, pump hot air into the room, then shut off. Heat may dissipate through windows, causing parts of the room to cool and resulting in a movement of hot air into colder regions of the room as the temperature attempts to even out. These change in temperatures, due to rapid changes in heat or noise in the ambient temperature, may be detected by a passive infrared sensor as a moving heat source which may normally trip the motion sensor and result in an alert.

When the passive infrared sensor of the motion sensor detects the motion of a heat source, the motion sensor may use data from any available temperature sensors to determine if the moving heat source is a person, or if the passive infrared sensor has detected a rapid change in heat or noise in the ambient temperature of the room near the motion sensor. If the temperatures detected by a temperature sensor that is part of or near the motion sensor during the same time period the passive infrared sensor detected a moving heat source indicate that the temperature in the room was changing, the motion sensor may disregard the motion detected by the passive infrared sensor as being caused by a the temperature change, and may decrease the sensitivity of the passive infrared sensor. The temperature change may be due to noise in the ambient temperature, for example, with the temperature dropping and rising in quick succession, or may be due to a rapid raise in heat in the room, for example, due to the activation of a heat source such as vent. Temperature sensors may also be located in heating ducts, radiators and on or near vents or other heat sources for the room, such as individual room heaters or oscillating heaters. There may be a threshold change in temperature that may need to be met for the detected motion to be disregarded. For example, very small fluctuations in ambient temperature, as detected by the temperature sensors, may not be considered to have caused the detection of motion by the passive infrared sensor. A temperature threshold may be based on the location of the temperature sensor. For example, a first threshold may be set for a temperature sensor on a wall of the room, a second threshold for a temperature sensor in a heating duct and a third threshold for temperature sensor located on or near a radiator. Further, the threshold may relate to a rate of change of temperature. For example, a threshold may be set for three degrees per minute. Such a threshold can be crossed regardless of an absolute temperature. Thus, for example, if a temperature sensor in a duct reports a temperature increase of at least three degrees over the past minute, the threshold is crossed regardless of whether the temperature of the duct changed from 55 degrees to 61 degrees or 73 degrees to 79 degrees. A more rapid rate at which a temperature is increasing may more reliably indicate the activation of an environmental heat source rather than a movement of an object in the room.

If the temperatures detected by the temperature sensor that is part of or near the motion sensor during the same time period the passive infrared sensor detected a moving heat source indicate that the temperature in the room was not changing, for example, any temperature change (absolute or rate) was less than the threshold, then the motion sensor may accept the detection of motion from the passive infrared sensor and generate an alert. The moving heat source detected by the passive infrared sensor may be a person, as the presence of a person in the room may result in a moving heat source that may be seen by the passive infrared sensor, but may not result any change, or a large enough change, in the temperature of the room as detected by the temperature sensor.

Checking for changes in the temperature of the room when motion is detected by the passive infrared sensor may allow for false reports of motion to be disregarded before an alert is generated by the motion sensor. The coincidence of a temperature change, including a rapid temperature rise or fluctuation, with the detection of the motion by the passive infrared sensor may be indicative of a false report of motion sensor, as the passive infrared sensor may have detected the temperature change as moving heat source. The passive infrared sensor may have too low a floor for the amount of moving heat that may be interpreted as the motion of a person. The floor may be adjusted upwards, reducing the sensitivity of the passive infrared sensor. The lack of a coinciding temperature change with the detection of motion by the passive infrared sensor may be indicative of a person moving in the room, as a person may not raise the ambient temperature of the room enough to be noticeable or pass a threshold, resulting in the passive infrared sensor detecting a moving heat source while the temperature sensors report no change in ambient temperature that could account for the detection of motion by the passive infrared sensor.

The smart home environment may include a hub computing device, which may be any suitable computing device for managing the smart home environment, including a security system of the smart home environment and automation system including other functions beyond security. The hub computing device may be a controller for a smart home environment. For example, the hub computing device may be or include a smart thermostat. The hub computing device also may be another device within the smart home environment, or may be a separate computing device dedicated to managing the smart home environment. The hub computing device may be connected, through any suitable wired and wireless connections, to a number of sensors distributed throughout an environment. Some of the sensors may, for example, be motions sensors, including passive infrared sensors used for motion detection, light detectors, cameras, microphones, entryway sensors, as well as Bluetooth, WiFi, or other wireless devices used as sensors to detect the presence of devices such as smartphones, tablets, laptops, or fobs. Sensors may be distributed individually, or may be combined with other sensors in sensor devices. For example, a sensor device may include a passive infrared sensor, used for motion detection, and a temperature sensor.

Signals from the sensors distributed throughout the environment may be sent to the hub computing device. The hub computing device may use the signals received from the sensors to make determinations about the environment, including managing the security system and automation functions of the smart home environment.

The hub computing device may receive trip signals, or alerts, from a motion sensor located in a room. The passive infrared sensor of the motion sensor may have detected a moving heat source within the room, and any temperature sensors connected to the motion sensor may have detected no rapid rise in heat in the room or temperature changes due to noise in the ambient temperature. The hub computing device may control, and have access to the current status of, the HVAC system of the smart home environment. The hub computing device may check the status of the HVAC system to determine if a vent, individual room heater, or oscillating heater, in the same room as, or in an area visible to the passive infrared sensor of, the motion sensor was turned on during the time period that the passive infrared sensor detected a moving heat source that resulted in the motion sensor sending an alert to the hub computing device.

If the hub computing device determines that a vent was turned on during the time period that the passive infrared sensor detected a moving heat source and that the vent is known to be located near window curtains, the hub computing device may discard the alert from the motion sensor, as the detected heat source may have been a window curtain moved by air from the heating vent and warmed by sunlight. The signal including the alert from the motion sensor may also include the location at which motion was detected. The hub computing device may use the location at which motion was detected to further corroborate that curtains were responsible for the movement, as the hub computing device may have access to a map or model of the room, including the location of the curtains.

There may be temperature sensors located in parts of the room away from the motion sensor. For example, the motion sensor may be placed in a first corner of the room, and there may be temperature sensors in the other three corners of the room. The temperature sensors may be standalone temperature sensors, or may be part of sensor devices that include other sensors. The temperature sensors may be connected, using any suitable wired or wireless connection, to the hub computing device.

The hub computing device may use the temperatures reported by other temperature sensors in the room with the motion sensor to determine if the motion sensor needs to be adjusted. For example, the motion sensor may be placed near a heat source, such as a window. The temperature detected by the temperature sensor that is part of, or located near, the motion sensor may be higher than temperatures detected by temperature sensors in other parts of the room during daylight hours. The hub computing device may determine, based on this temperature differential, that the area around the motion sensor is being heated by sunlight coming through the window during daylight hours, causing the temperature sensor that is part of, or located near, the motion sensor to detect higher temperatures than temperature sensors elsewhere in the room. The hub computing device may determine and send adjustments to the motion sensor, for example, reducing the sensitivity of the motions sensor during daylight hours in order to reduce false reports of motion detection from the passive infrared sensor and false alerts from the motion sensor.

The hub computing device may also correlate the temperatures reported by other temperature sensors in the room with the status of the HVAC system to determine if the motion sensor has been placed near a vent. For example, the temperature detected by the temperature sensor that is part of, or located near, the motion sensor may be higher than temperatures detected by temperature sensors in other parts of the room over certain time periods. The hub computing device may determine that these time periods coincide with time periods when a specific vent of the HVAC system is on and pumping hot air into the room and for some time after the vent is turned back off. The hub computing device may determine that the motion sensor has been placed near the heat vent or in a heating duct, resulting in the temperature sensor that is part of, or located near, the motion sensor detecting higher temperatures than the temperature sensors in the rest of the room during time periods when the vent is pumping, or has just pumped, hot air into the room.

When the hub computing device has determined that a motion sensor has been placed near a heat source, the hub computing device may notify a user of the smart home environment. For example, the hub computing device may send a message, via email, SMS, MMS, or application notification, to a computing device associated with a user of the smart home environment, such as a smartphone, tablet, laptop, or wearable computing device. The hub computing device may display a message, for example, on a display of the hub computing device or other display that is part of the smart home environment, such as a television or display on a smart thermostat.

Sensors in the smart home environment may send indications to the hub computing device actively or passively. For example, a motion sensor may actively produce an output signal when motion is and is not detected, with the signal including the indication of whether or not motion was detected. Alternatively, the motion sensor may only produce active output when motion is detected, with the output being the signal that motion was detected, and may otherwise produce no output when not motion is detected, with the lack of output acting a signal that motion was not detected. This may allow the motion sensor to operate using less power. The hub computing device may interpret the lack of active output from a motion sensor as a signal indicating that no motion has been detected by the sensor.

FIG. 1 shows an example system suitable for motion sensor adjustment according to an implementation of the disclosed subject matter. A hub computing device 100 may include a signal receiver 110, a sensor adjuster 120, HVAC control 130, and storage 140. The hub computing device 100 may be any suitable device, such as, for example, a computer 20 as described in FIG. 13, for implementing the signal receiver 110, the sensor adjuster 120, the HVAC control 130, and storage 140. The hub computing device 100 may be, for example, a controller 73 as described in FIG. 11. The hub computing device 100 may be a single computing device, or may include multiple connected computing devices, and may be, for example, a smart thermostat, other smart sensor, smartphone, tablet, laptop, desktop, smart television, smart watch, or other computing device that may be able to act as a hub for a smart home environment, which may include a security system and automation functions. The smart home environment may be controlled from the hub computing device 100. The hub computing device 100 may also include a display. The signal receiver 110 may be any suitable combination of hardware or software for receiving signals generated by sensors that may be part of the smart home environment and may be connected to the hub computing device 100. The sensor adjuster 120 may be any suitable combination of hardware and software for determining adjustments for motion sensors in the smart home environment based on signals received from other sensors throughout the smart home environment. The HVAC control 130 may be any suitable hardware and software for controlling an HVAC system of the smart home environment, and may store the current status of the HVAC system in HVAC status 155 in the storage 140. The HVAC status 155 may be stored the storage 140 in any suitable manner.

The hub computing device 100 may be any suitable computing device for acting as the hub of a smart home environment. For example, the hub computing device 100 may be a smart thermostat, which may be connected to various sensors throughout an environment as well as to various systems within the environment, such as HVAC systems, or it may be another device within the smart home environment. The hub computing device 100 may include any suitable hardware and software interfaces through which a user may interact with the hub computing device 100. For example, the hub computing device 100 may include a touchscreen display, or may include web-based or app based interface that can be accessed using another computing device, such as a smartphone, tablet, or laptop. The hub computing device 100 may be located within the same environment as the smart home environment it controls, or may be located offsite. An onsite hub computing device 100 may use computation resources from other computing devices throughout the environment or connected remotely, such as, for example, as part of a cloud computing platform. The hub computing device 100 may be used to arm a security system of the smart home environment, using, for example, an interface on the hub computing device 100. The security system may be interacted with by a user in any suitable matter, including through a touch interface or voice interface, and through entry of a PIN, password, or pressing of an "arm" button on the hub computing device 100.

The hub computing device 100 may include a signal receiver 110. The signal receiver 110 may be any suitable combination of hardware and software for receiving signals from sensors connected to the hub computing device 100. For example, the signal receiver 110 may receive signals from any sensors distributed throughout a smart home environment, either individually or as part of sensor devices. The signal receiver 110 may receive any suitable signals from the sensors, including, for example, audio and video signals, signals indicating light levels, signals indicating detection or non-detection of motion, signals whether entryways are open, closed, opening, closing, or experiencing any other form of displacement, signals indicating the current climate conditions within and outside of the environment, smoke and carbon monoxide detection signals, and signals indicating the presence or absence of occupants in the environment based on Bluetooth or WiFi signals and connections from electronic devices associated with occupants or fobs carried by occupants. The signal receiver 110 may pass received signals to other components of the hub computing device 100 for further processing, such as, for example, detection of tripped motion and entryway sensors and use in automation and security determinations, and for storage. The signal receiver 110 may also be able to receive, or to associate with a received signal, an identification for the sensor from which the signal was received. This may allow the signal receiver 110 to distinguish which signals are being received from which sensors throughout the smart home environment. For example, a motion sensor may send a sensor identification to the signal receiver 110 when actively outputting a signal indicating motion has been detected. The motion sensor may not actively output a signal when no motion is detected, so the signal receiver may be able to determine that the lack of active output from the low power motion sensor is a signal indicating no motion was detected, and may associate this signal with the identity of the motion sensor from which no output was received.

The hub computing device 100 may include a sensor adjuster 120. The sensor adjuster 120 may be any suitable combination of hardware and software for determining adjustments for motion sensors in the smart home environment. The sensor adjuster 120 may check signals received by the signal checker 110 from a motion sensor and temperature sensors located in the same room as a motion sensor, and may also check the HVAC status 155. The sensor adjuster 120 may determine if the motion sensor is generating false alerts based on the coincide of HVAC activity with signals from the motion sensor indicating that motion has been detected, or based on the temperatures detected by other temperature sensors. The sensor adjuster 120 may determine adjustments to the sensitivity of the motion sensor in order to prevent the generation of false alerts.

The hub computing device 100 may include the HVAC control 130. The HVAC control 130 may be any suitable combination of hardware and software controlling the HVAC system of the smart home environment. For example, the HVAC control 130 may turn vents throughout the smart home environment on and off on a schedule, as needed, or as instructed by an occupant of the smart home environment, and have them pump hot air or cool air, in order to maintain specific temperature levels in various rooms. The desired temperature level for a room may vary based on time of day, day of year, a mode of the smart home environment, and whether there are any occupants in the environment. The HVAC control 130 may store the current status of the HVAC system in the HVAC status 155.

The storage 140 may be any suitable storage hardware connected to the hub computing device 100, and may store the HVAC status 155 in any suitable manner. For example, the storage 140 may be a component of the hub computing device, such as a flash memory module or solid state disk, or may be connected to the hub computing device 100 through any suitable wired or wireless connection. It may be a local storage, i.e., within the environment within which the hub computing device operates, or it may be partially or entirely operated by a remote service, such as a cloud-based monitoring service as described in further detail herein. The HVAC status 155 may include the current status of the HVAC system, and any suitable number of historical statuses of the HVAC system.

Figure 2:
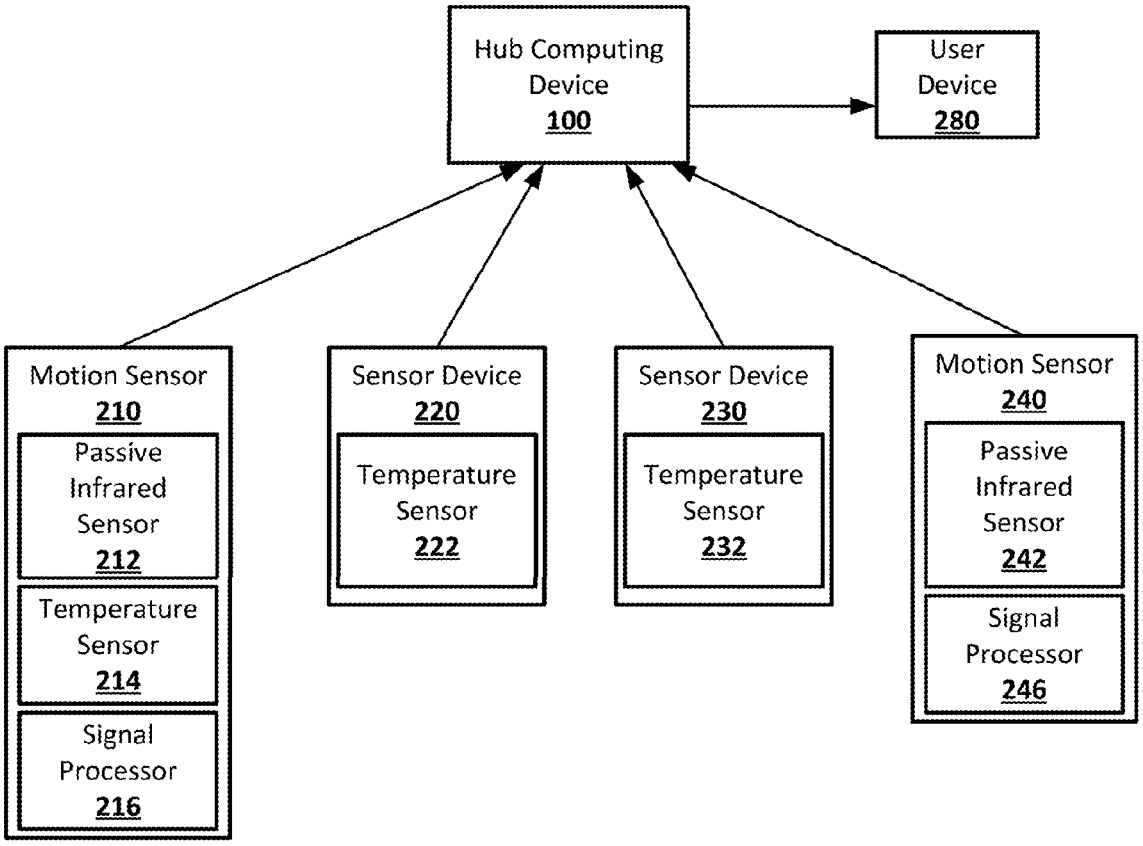
FIG. 2 shows an example arrangement suitable for motion sensor adjustment according to an implementation of the disclosed subject matter.

FIG. 2 shows an example arrangement suitable for motion sensor adjustment according to an implementation of the disclosed subject matter. The hub computing device 100 may be the hub, or controller, for a smart home environment. Various sensor devices throughout the environment may be connected to the hub computing device 100. Each sensor device may have any suitable assortment of sensors. For example, the motion sensor 210, sensor device 220, sensor device 230, and motion sensor 240 may be connected to the hub computing device 100. The motion sensor 210 may include a passive infrared sensor 212, a temperature sensor 214, and a signal processor 216, which may process signals from the passive infrared sensor 212 and the temperature sensor 214. The sensor device 220 may include temperature sensor 222. The sensor device 230 may include a temperature sensor 232. The motion sensor 240 may include a passive infrared sensor 242 and a signal processor 246. The motions sensors 210 and 240 may be low power motion sensors using a passive infrared sensor to detect the motion of heat. The temperature sensors 214, 222 and 232 may be any suitable sensors for detecting the ambient temperature of the environment in the vicinity of the sensor.

The sensors of the motion sensors 210 and 240 and the sensors devices 220 and 230 may generate signals that may be received by the signal receiver 110 of the hub computing device 100. The signals may be the product of active output the sensors, or may be the result of a sensor not generating any output, for example, a lack of output from the motion sensor 210 when no motion is detected.

The hub computing device 100 may also be connected, in any suitable manner, to a user computing device 280. The user computing device 280 may be any suitable computing device, such as, for example, a smartphone, tablet, laptop, or smartwatch or other wearable computing device, which a user may use to interface with the hub computing device 100 and control the security system. The hub computing device 100 may be able to send notifications, alerts or requests to the user computing device 280, either through a direct connection, such as LAN connection, or through a WAN connection such as the Internet. This may allow the user of the user computing device 280 to monitor and manage the smart home environment even when the user is not physically near the hub computing device 100. For example, when the sensor adjuster 120 determines that a sensor, such as the motion sensor 210, has been placed near a heat source, the hub computing device 100 may send a notification, alert, or request for action to the user computing device 280.

Figure 3A:
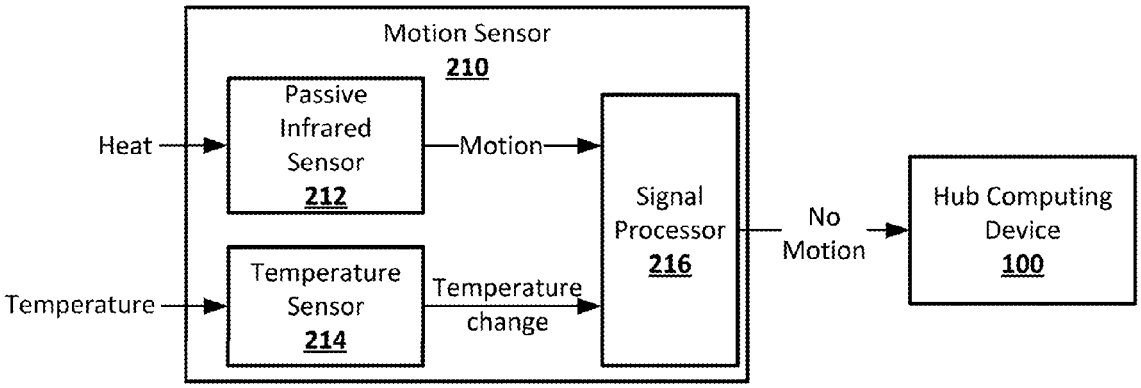
FIGS. 3A, 3B and 3C show example arrangements suitable for motion sensor adjustment according to an implementation of the disclosed subject matter.

FIG. 3A shows an example arrangement suitable for motion sensor adjustment according to an implementation of the disclosed subject matter. The passive infrared sensor 212 of the motion sensor 210 may detect a moving heat source in the room. The passive infrared sensor 212 may send a signal to the signal processor 216 indicating that motion has been detected. The signal may directly indicate the detection of motion, or may include unprocessed readings from the passive infrared sensor 212 which may be processed by the signal processor 216 to determine that there is a moving heat source in the room.

The temperature sensor 214 may detect the ambient temperature of the room. The temperature sensor 214 may send a signal to the signal processor 216 indicating that the ambient temperature of the room has changed. The signal may directly indicate that the temperature has changed, or may include unprocessed temperatures which may be processed by the signal processor 216 to determine that the temperature has changed. For example, the signal processor 216 may analyze temperatures detected by the temperature sensor 214 from before and during the time period during which the passive infrared sensor 212 detected a moving heat source. The analysis of the temperatures may determine that the temperature in the room has varied beyond some threshold amount, for example, rapidly rising, or fluctuating. Likewise, the temperature sensor 214 may detect the temperature in a heating duct or on or near a radiator meant to heat a MOM.

The signal processor 216 may receive the signals from the passive infrared sensor 212 and the temperature sensor 214 contemporaneously. The signal processor 216 may determine, based on the detection of a moving heat source by the passive infrared sensor 212 contemporaneous with a change in the ambient temperature of the room or environmental heater detected by the temperature sensor 214, that the passive infrared sensor 212 has generated false detection of motion. For example, the temperature of the room near the motion sensor 210 may have increased or fluctuated rapidly, resulting in the passive infrared sensor 212 detecting a moving heat source, as such temperature changes are not indicative of a person moving in the room. The signal processor 216 may discard the motion detected by the passive infrared sensor 212, and may send a signal, actively or passively, to the hub computing device 100 indicating that the motion sensor 210 does not detect any motion in the room. This may prevent changes in temperature in the room, including rapid temperature rises or noise in the ambient temperature, from generating false alerts of motion in the room.

Figure 3B:
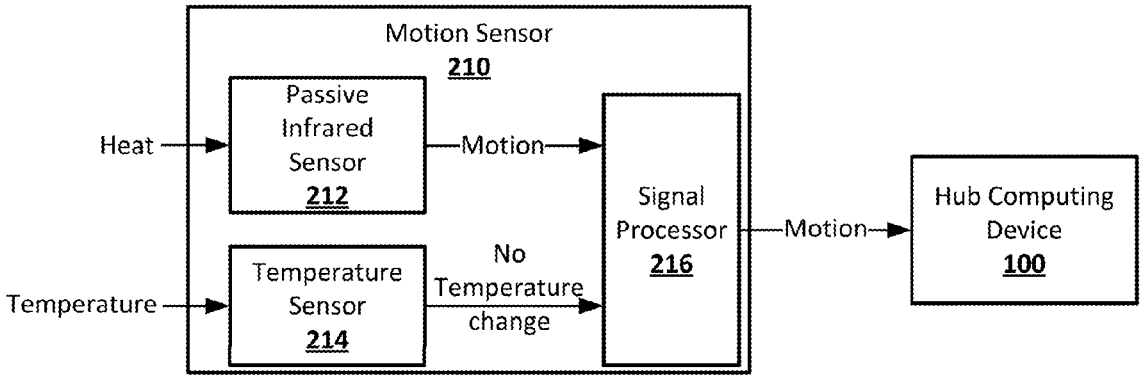

FIG. 3B shows an example arrangement suitable for motion sensor adjustment according to an implementation of the disclosed subject matter. The passive infrared sensor 212 of the motion sensor 210 may detect a moving heat source in the room. The passive infrared sensor 212 may send a signal to the signal processor 216 indicating that motion has been detected. The signal may directly indicate the detection of motion, or may include unprocessed readings from the passive infrared sensor 212 which may be processed by the signal processor 216 to determine that there is a moving heat source in the room.

The temperature sensor 214 may detect the ambient temperature of the room or an environmental heater. The temperature sensor 214 may send a signal to the signal processor 216 indicating that the ambient temperature of the room or heater has not changed. The signal may directly indicate that the temperature has not changed, or may include unprocessed temperatures which may be processed by the signal processor 216 to determine that the temperature has not changed. For example, the signal processor 216 may analyze temperatures detected by the temperature sensor 214 from before and during the time period during which the passive infrared sensor 212 detected a moving heat source. The analysis of the temperatures may determine that the temperature in the room has not varied beyond some threshold amount, for example, has stayed within a narrow range.

The signal processor 216 may receive the signals from the passive infrared sensor 212 and the temperature sensor 214 contemporaneously. The signal processor 216 may determine, based on the detection of a moving heat source by the passive infrared sensor 212 contemporaneous with no changes in the ambient temperature of the room detected by the temperature sensor 214, that the passive infrared sensor 212 has detected a person moving in the room. For example, the temperature of the room near the motion sensor 210 may not have increased or fluctuated rapidly, which may indicate that the moving heat source detected by the passive infrared sensor 212 is a person moving in the room. The signal processor 216 may send a signal, actively or passively, to the hub computing device 100 indicating that the motion sensor 210 has detected motion in the room.

Figure 3C:
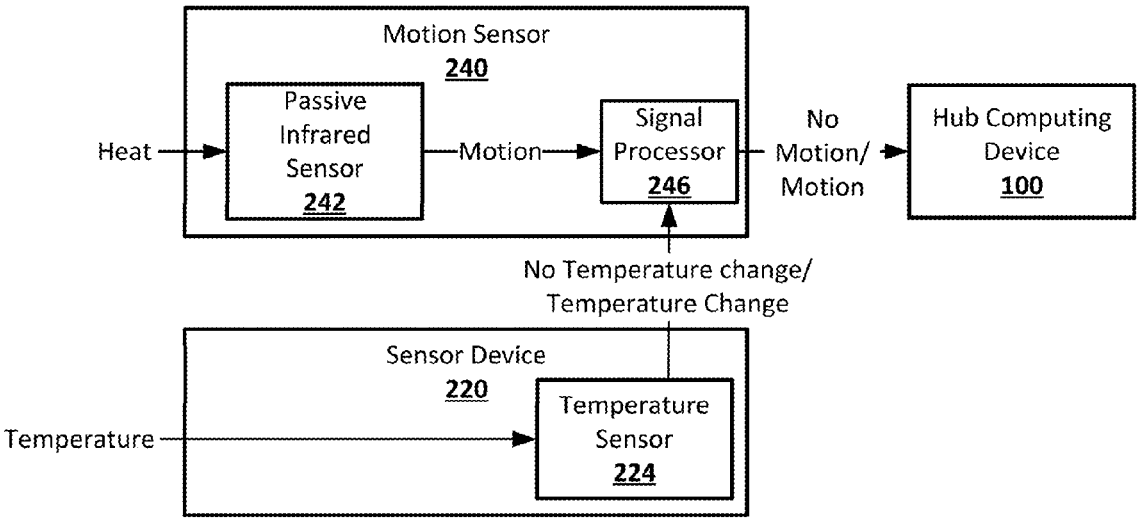

FIG. 3C shows an example arrangement suitable for motion sensor adjustment according to an implementation of the disclosed subject matter. The motion sensor 240 may include a passive infrared sensor 242, but may not include a temperature sensor. The passive infrared sensor 242 of the motion sensor 240 may detect a moving heat source in the room. The passive infrared sensor 242 may send a signal to the signal processor 246 indicating that motion has been detected. The signal may directly indicate the detection of motion, or may include unprocessed readings from the passive infrared sensor 242 which may be processed by the signal processor 246 to determine that there is a moving heat source in the room.

The temperature sensor 224 may be part of the sensor device 210, and may detect the ambient temperature of the room. The sensor device 220 may co-located with the motion sensor 240, so that temperature readings from the temperature sensor 224 may reflect the temperature in the vicinity of the motion sensor 250. The temperature sensor 224 may send a signal to the signal processor 246 indicating whether the ambient temperature of the room and/or environmental heater has or has not changed. The signal may be sent through any suitable wired or wireless connection. The signal may directly indicate that the temperature has or has not changed, or may include unprocessed temperatures which may be processed by the signal processor 246 to determine whether temperature has or has not changed. For example, the signal processor 246 may analyze temperatures detected by the temperature sensor 224 from before and during the time period during which the passive infrared sensor 242 detected a moving heat source. The analysis of the temperatures may determine that the temperature in the room and/or of the heater has varied beyond some threshold amount, for example, rapidly rising, or fluctuating, or has not varied beyond the threshold, for example, staying within some specified range.

The signal processor 246 may receive the signals from the passive infrared sensor 242 and the temperature sensor 224 contemporaneously. The signal processor 246 may determine, based on the detection of a moving heat source by the passive infrared sensor 242 contemporaneous with a change, or no change, in the ambient temperature of the room detected by the temperature sensor 224, whether the passive infrared sensor 242 has generated false detection of motion. For example, the temperature of the room near the motion sensor 240 may have increased or fluctuated rapidly, resulting in the passive infrared sensor 242 detecting a moving heat source, as such temperature changes are not indicative of a person moving in the room. The signal processor 246 may discard the motion detected by the passive infrared sensor 242, and may send a signal, actively or passively, to the hub computing device 100 indicating that the motion sensor 240 does not detect any motion in the room. The temperature of the room or heater may not have changed, which may be indicative of a person moving in the room. The signal processor 246 may send a signal to the hub computing device 100 indicating that the motions sensor 240 has detected motion in the room.

Figure 4:
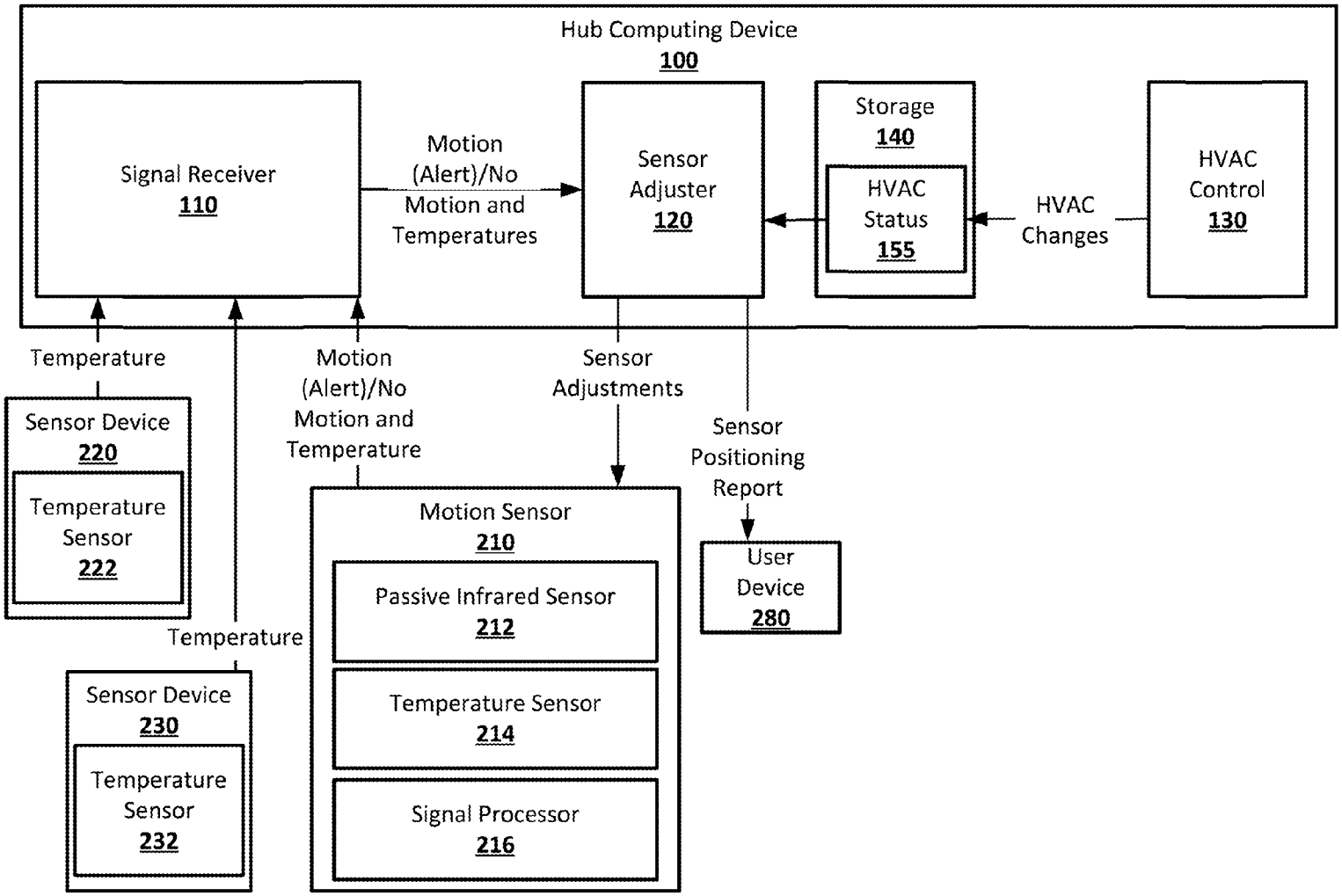
FIG. 4 shows an example arrangement suitable for motion sensor adjustment according to an implementation of the disclosed subject matter.

FIG. 4 shows an example arrangement suitable for motion sensor adjustment according to an implementation of the disclosed subject matter. The signal receiver 210 may receive a signal from the motion sensor 210. The signal may indicate whether the motion sensor 210 has detected motion in the room in which it is located, for example, as determined by the signal processor 216 and may also include the temperature near the motion sensor 210 as detected by the temperature sensor 214. A signal indicating that motion has been detected may be an alert signal sent to the hub computing device 100, and may generated when the passive infrared sensor 212 has detected a moving heat source and the temperature sensor 214 has not detected a change in the ambient temperature that would account for the detection of the moving heat source.

The signals from the motion sensor 210 may be sent from the signal receiver 110 to the signal adjuster 120. For example, if the motion sensor 210 has detected motion and generated an alert, the alert may be passed to the signal adjuster 120. The signal adjuster 120 may receive the HVAC status 155 from the storage 140. The HVAC status 155 may include the current status of the HVAC system, as well as past statuses, based on changes to the HVAC system made by the HVAC controller 130.

The signal adjuster 120 may use the HVAC status 155 to determine if an alert, indicating the detection of motion, from the motion sensor 210 is a false alert. The signal adjuster 120 may determine, from the HVAC status 155, if a vent in the same room as the motion sensor 210 was on, and pumping air into the room, during the time period over which the motion sensor 210 detected motion based on a moving heat source detected by the passive infrared sensor 212. The sensor adjuster 120 may also determine if such as vent in the room is located near an object that may be moveable by air from the vent and susceptible to heating from an outside source. For example, the vent may be near a window curtain, which may been blown around when the vent is active, and may be warmed by sunlight coming through the window. If the HVAC status 155 indicates that such a vent was operating when motion was detected by the motion sensor 210, the signal adjuster may cause the alert from the motion sensor 210 to be disregarded as a false alert. The passive infrared sensor 212 may have detected a warm window curtain, moved by air from the vent, as a moving heat source. The signal adjuster 120 may also be able to determine, based on the alert signal from the motion sensor 210, where in the room motion was detected, and may further cross-check the location of the detected motion with the known location of objects such as window curtains, to further determine that the alert is a false alert.

After determining that the alert is a false alert and discarding it, the signal adjuster 120 may determine an adjustment to the sensitivity of the motion sensor 210 to avoid future false alerts. For example, the signal adjuster 120 may determine that the sensitivity of the motion sensor 210 needs to be lowered, raising the floor for that amount of movement of a heat source that needs to be detected before the motion sensor 210 sends an alert signal indicating detected motion to the hub computing device 100.

The signal receiver 110 may also receive signals from the sensor devices 220 and 230 indicating the temperature in the room in the vicinity of each of the sensor devices 220 and 230. The sensor devices 220 and 230 may be located in the same room as the motion sensor 210, but may be in different areas of the room from the motion sensor 210. The signal receiver 110 may send the temperatures from the sensor devices 220 and 230 to the signal adjuster 120.

The signal adjuster 120 may use the temperatures from the sensor devices 220 and 230, the temperature from the temperature sensor 214 on the motion sensor 210, and the HVAC status 155, to determine if the motion sensor 210 is located near a heat source. Being located near a heat source may interfere with the ability of the passive infrared sensor 212 to detect people as moving heat sources, and may result in false alerts. The signal adjuster 120 may compare the temperatures detected by the sensor devices 220 and 230 to the temperatures detected to the temperature sensor 214 to determine if the temperature sensor 214 detects higher temperatures that the sensor devices 220 and 230 at any given time. If there are periods of time where the temperature detected by the temperature sensor 214 is higher, by more than some threshold amount, than the temperatures detected by the sensor devices 220 and 230, then the motion sensor 210 may be located near a heat source.

The signal adjuster 120 may determine, for example, that the temperature sensor 214 detects higher temperatures during daylight hours than the sensor devices 220 and 230. This may indicate that the motion sensor 210 has been placed in direct sunlight. The signal adjuster 120 may determine that the temperature sensor 214 detects higher temperatures than the sensor devices 220 and 230 when the HVAC status 155 indicates that a vent in the room is on and pumping hot air. This may indicate that the motion sensor 210 has been placed near a vent. The signal adjuster 120 may determine an adjustment for the motion sensor 210, for example, decreasing the sensitivity of the motion sensor 210 to prevent false alerts being triggered by the proximity of the motion sensor 210 to a heat source.

Figure 5:
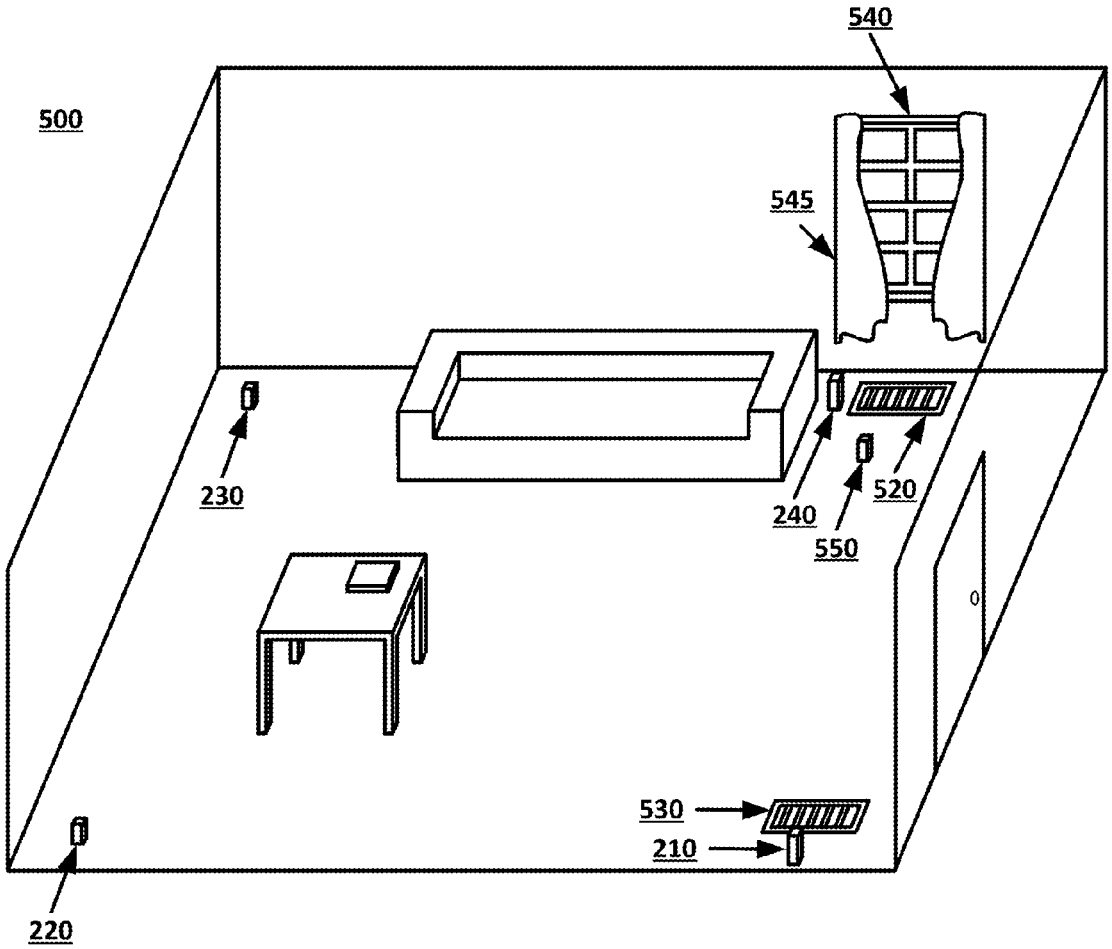
FIG. 5 shows an example environment suitable for motion sensor adjustment according to an implementation of the disclosed subject matter.

FIG. 5 shows an example environment suitable for motion sensor adjustment according to an implementation of the disclosed subject matter. The motion sensor 210 and the motion sensor 240 may be used to monitor the same room 500, which may be, for example, the living room of a home. Sensor devices 220, 230, and 250 may also be positioned throughout the room, and may include temperature sensors, such as the temperature sensors 222 and 232. The room 500 may also include vents 520 and 530, which may be connected to the HVAC system of the smart home environment and controlled by, for example, the HVAC controller 130. The room 500 may also include a window 540, with a window curtain 545, located above the vent 520.

The temperature of the room 500 may rise when the vents 520 and 530 pump hot air into the room. The change in temperature of the room 500 may result in the passive infrared sensor 212 of the motion sensor 210, or the passive infrared sensor 242 of the motion sensor 240, detecting a moving heat source. The motion sensor 210 may include the temperature sensor 212, which may be used to determine that the moving heat source detected by the passive infrared sensor 212 was the result of a change in temperature near the motion sensor 210, resulting in the signal processor 216 discarding the detected motion as a false alert. The motion sensor 240 may not include its own temperature sensor, and may the temperature sensor of the sensor device 550, co-located with the motion sensor 240, to determine that the moving heat source detected by the passive infrared sensor 242 was the result of a change in temperature near the motion sensor 240, resulting in the signal processor 246 discarding the detected motion as a false alert.

The passive infrared sensor 212 may detect motion that is not accompanied by a change in temperature as detected by the temperature sensor 214. The motion sensor 210 may send an alert signal indicating motion has been detected in the room 500 to the hub computing device 100. The signal adjuster 120 of the hub computing device may receive the alert, for example, from the signal receiver 110, and may check the HVAC status 155 in the storage 140. The signal adjuster 120 may determine that the vent 520 was operating and pumping air into the room 500 during the same time period in which the passive infrared sensor 212 detected a moving heat source. Based on the location of the vent 520 and the window curtains 545, as well as the time of day, the signal adjuster 120 may determine that the passive infrared sensor 212 detected the window curtain 545, blown by the vent 520 and warmed by sunlight through the window 540, as a moving heat source. The signal adjuster 120 may discard the alert from the motion sensor 210, and may adjust the motion sensor 210 to be less sensitive. The signal adjuster 120 may further determine that the cause of the detected moving heat source was the window curtain 545 may determining the location of the detected motion in the alert signal from the motion sensor 210 and correlating it with the location of the window 540.

The temperature sensor 212 of the motion sensor 210 may send signals indicating the detected temperature at the location of the motion sensor 210 to the hub computing device 100. The sensor devices 220 and 230, located in other parts of the room 500, may also send signals indicating detected temperatures at their locations to the hub computing device 100. The signal adjuster 120 may compare the detected temperatures and determine that at certain times, the temperature sensor 212 detects higher temperatures than the sensor devices 220 and 230. The signal adjuster 120 may check the HVAC status 155 and correlate the times when these higher temperatures are detected with times when the vent 530 is operating to pump hot air into the room 500. The proximity of the motion sensor 210 to the vent 530, relative to the distance from the vent 530 of the sensor devices 220 and 230, may result in the motion sensor 210 being in a hotter portion of the room 500 when the vent 530 is pumping hot air into the room 500. The signal adjuster 120 may adjust the motion sensor 210, for example, lowering the sensitivity of the motion sensor 210 to prevent false alerts caused by being located near a heat source. The signal adjuster 120 may also send a notification to a user or occupant of the smart home environment, indicating that the motion sensor 210 may need to be moved from its current position to ensure optimal performance.

The sensor device 550, including a temperature sensor and co-located with the motion sensor 240, may send signals indicating the detected temperature at the location of the sensor device 550 to the hub computing device 100. The sensor devices 220 and 230, located in other parts of the room 500, may also send signals indicating detected temperatures at their locations to the hub computing device 100. The signal adjuster 120 may compare the detected temperatures and determine that at certain times, the sensor device 550 detects higher temperatures than the sensor devices 220 and 230. The signal adjuster 120 may determine that the higher temperatures occur during daylight house. The signal adjuster may also be able to determine, for example, from a stored map or model of the room 500, that the sensor device 550 and motion sensor 240 are located near the window 540. The proximity of the motion sensor 240 to the window 540 relative to the distance from the window 540 of the sensor devices 220 and 230, may result in the motion sensor 240 being in a hotter portion of the room 500 during daylight hours when sunlight warms part of the room 500 through the window 540. The signal adjuster 120 may adjust the motion sensor 240, for example, lowering the sensitivity of the motion sensor 210 to prevent false alerts caused by being located near a heat source. The signal adjuster 120 may also send a notification to a user or occupant of the smart home environment, indicating that the motion sensor 240 may need to be moved from its current position to ensure optimal performance.

Figure 6:
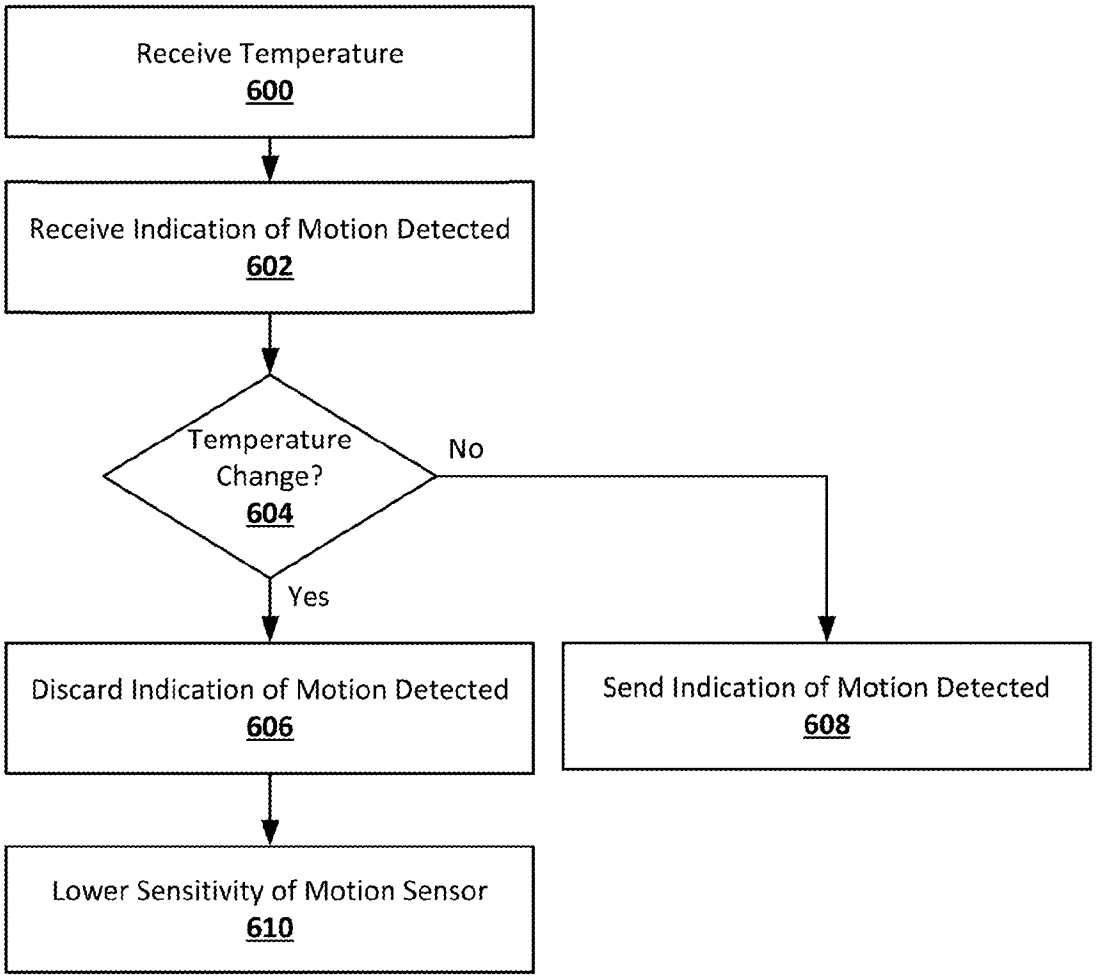
FIG. 6 shows an example of a process suitable for motion sensor adjustment according to an implementation of the disclosed subject matter.

FIG. 6 shows an example of a process suitable for motion sensor adjustment according to an implementation of the disclosed subject matter. At 600, a temperature may be received. For example, the signal processor 216 may receive a temperature detected by the temperature sensor 214 of the motion sensor 210.

At 602, an indication that motion has been detected may be received. For example, the signal processor 216 may receive an indication from the passive infrared sensor 212 that a moving heat source has been detected in the room 500. The indication that motion has been detected may be directly included in a signal from the passive infrared sensor 212, or may be determined by the signal processor 216 based on current and past readings received from the passive infrared sensor 212.

At 604, whether the temperature has changed may be determined. For example, the signal processor 216 may determine, or receive from the temperature sensor 214 a determination of, whether the temperature near the motion sensor 210 has changed during the time period in which the passive infrared sensor 212 detected a moving heat source. The temperature change may be determined by analyzing a number of detected temperatures over the time period. If the temperature has changed, for example, the temperatures over the time period show a rapid rise or fluctuation indicative of noise in the ambient nature, flow may proceed 606. Otherwise, if the temperature did not change, for example, the temperature over the time period did not vary outside of a certain range, flow may proceed to 608.

At 606, the indication of motion detection may be discarded. For example, the signal processor 216 may discard the indication from the passive infrared sensor 212 that a moving heat was detected in the room 500, as the passive infrared sensor 212 may have detected a change in the ambient temperature near the motion sensor 210 rather than a person moving in the room. This may prevent the motion sensor 210 from sending a false alert to the hub computing device 100.

At 608, an indication of motion detected may be sent. For example, motion sensor 210 may send an alert indicating that motion was detected to the hub computing device 100. The hub computing device 100 may handle the alert in any suitable manner, including, for example, checking the alert with the signal adjuster 120 and sending out an alert, sounding an alarm, or sending out a notification as appropriate if the signal adjuster 120 determines the alert is not a false alert.

At 610, the sensitivity of the motion sensor may be lowered. In response to the determination that the passive infrared sensor 212 detected a change in ambient temperature as a moving heat source, the motion sensor 210 may lower its sensitivity. This may make it less likely that the passive infrared sensor will produce another false alert based on a change in ambient temperature in the future.

Figure 7:
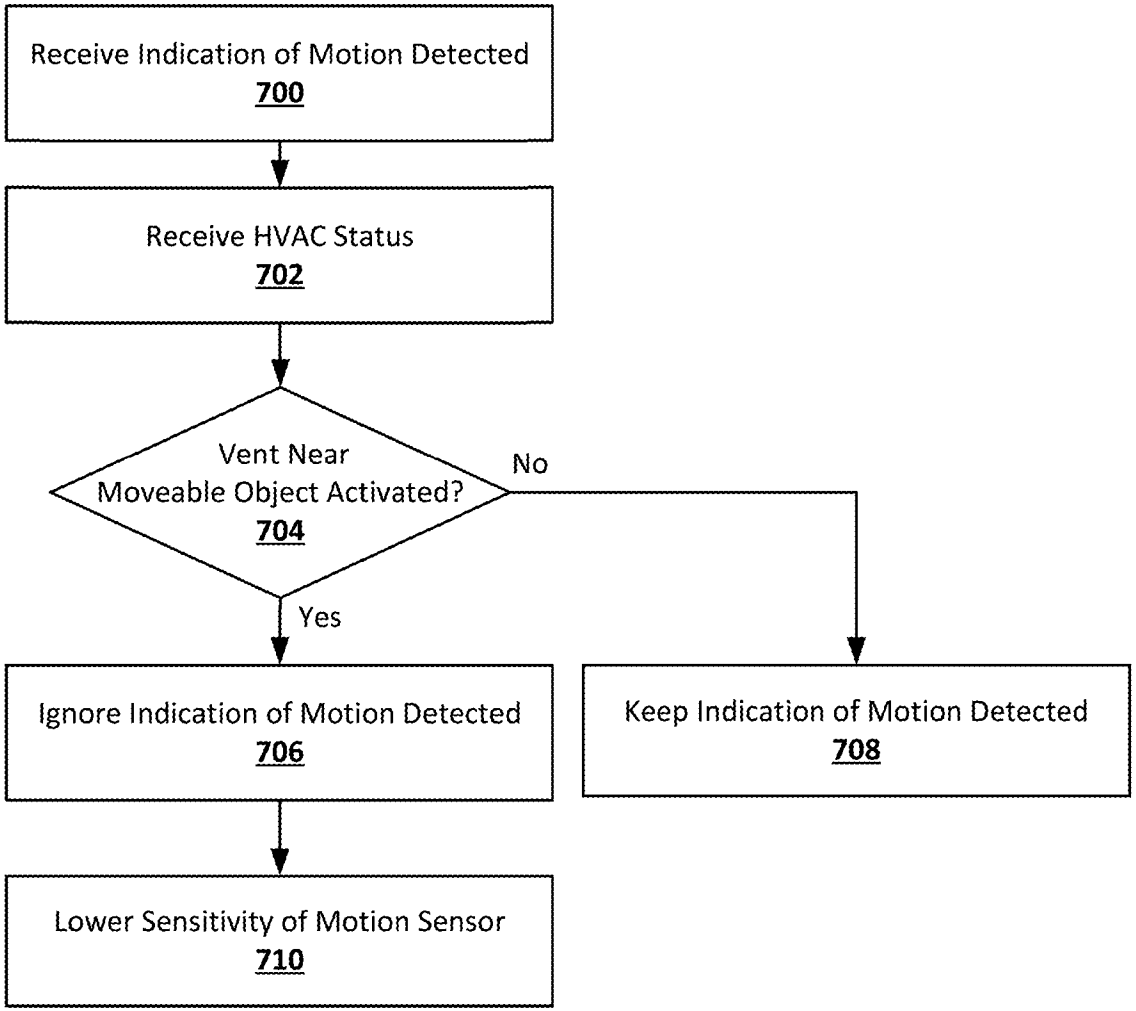
FIG. 7 shows an example of a process suitable for motion sensor adjustment according to an implementation of the disclosed subject matter.

FIG. 7 shows an example of a process suitable for motion sensor adjustment according to an implementation of the disclosed subject matter. At 600, an indication that motion has been detected may be received. For example, the hub computing device 100 may receive an alert signal with an indication that motion has been detected by the motion sensor 210 or the motion sensor 240. The alert signal may be received by, for example, the signal receiver 110, and then the signal adjuster 120

At 702, HVAC status may be received. For example, the signal adjuster 120 of the hub computing device 100 may receive the HVAC status 155 from the storage 140.

At 704, whether a vent near a moveable object was activated may be determined. For example, the signal adjuster 120 may use the HVAC status 155 to determine if a vent near an object moveable by air from the vent, such as the window curtains 545, was activated during the same time period in which the motion sensor that generated the alert signal detected motion. If such a vent, for example, the vent 520, was activated, flow may proceed 706. Otherwise, if no such vent was activated, flow may proceed to 708.

At 706, the indication of motion detected may be ignored. For example, the vent 520 may have been active when the motion sensor 210 generated the alert signal based on the detection of a moving heat source by the passive infrared sensor 212. Air being pumped through the vent 520 may have caused the window curtains 545 to move. The window curtains 545 may have been warmed by sunlight through the window 540, resulting in the window curtains 545 appearing as a moving heat source to the passive infrared sensor 212. The signal adjuster 120 may discard as a false alert the alert signal from the motion sensor 210 that indicated motion was detected.

At 708, the indication that motion was detected may be kept. For example, the vent 520 may not have been active when the motion sensor 210 generated the alert signal, indicating that the passive infrared sensor 212 detected a moving heat source that was not the window curtains 545. The alert signal indicating motion was detected may be kept, and may be handled by the hub computing device 100 in any suitable manner, such as, for example, sending out an alert, sounding an alarm, or sending a notification to an occupant or other suitable party.

At 710, the sensitivity of the motion sensor may be lowered. In response to the determination that the passive infrared sensor 212 detected a moving window curtains 545 as a moving heat source, the signal adjuster 120 may determine an adjustment for the motion sensor 210, lowering its sensitivity. This may make it less likely that the passive infrared sensor will produce another false alert based on the movement of warm window curtains 545.

Figure 8:
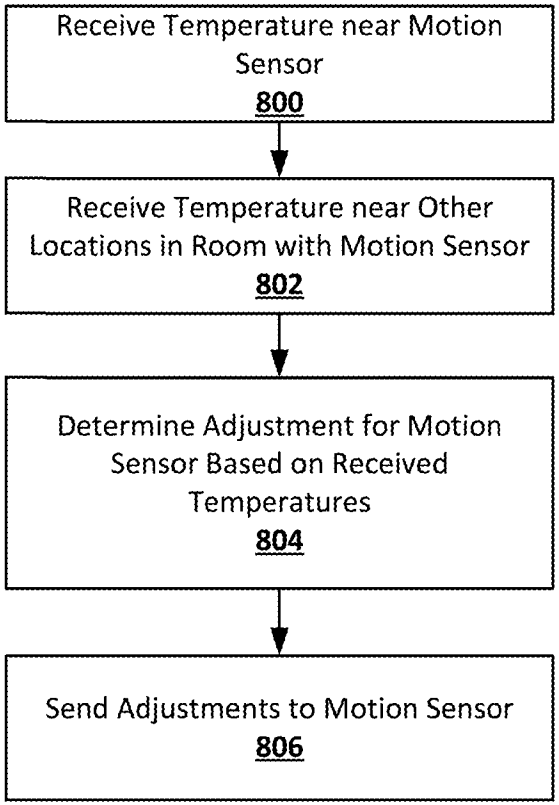
FIG. 8 shows an example of a process suitable for motion sensor adjustment according to an implementation of the disclosed subject matter.

FIG. 8 shows an example of a process suitable for motion sensor adjustment according to an implementation of the disclosed subject matter. At 800, a temperature near a motion sensor may be received. For example, the hub computing device 100 may receive the temperature near the motion sensor 210 as detected by the temperature sensor 214, or the temperature near the motion sensor 240 as detected by the temperature sensor of the sensor device 550. The temperature may be received by the signal receiver 110, and then by the signal adjuster 120.

At 802, temperatures near other locations in the room with the motion sensor may be received. For example, the hub computing device 100 may receive the temperature from other areas of the room 500 as detected by the temperature sensor 222 of the sensor device 220 and the temperature sensor 232 of the sensor device 230. The temperatures may be received by the signal receiver 110, and then by the signal adjuster 120.

At 804, an adjustment for the motion sensor may be determined based on the temperatures. For example, if the temperature at the motion sensor 210 is determined to be higher than the temperatures at the sensor devices 220 and 230 at specific times, the motion sensor 210 may need to be adjusted. For example, the HVAC status 155 may be used to determine that the motion sensor 210 experiences higher temperatures than the sensor devices 220 and 230 when the vent 530 is pumping hot air in the room 500. This may indicate that the motion sensor 210 has been placed too close to the vent 530. A model of the room 500, which may indicate the relative positions of the vent 530 and the motion sensor 210, may also be used to determine that the motion sensor 210 is too close to the vent 530. It may be determined, for example, by the sensor adjuster 120, that the sensitivity of the motion sensor 210 should be lowered to prevent false alerts. If the temperature at the motion sensor 240, for example, as detected through the sensor device 550, is determined to be higher than the temperatures at the sensor devices 220 and 230 at specific times, the motion sensor 240 may need to be adjusted. For example, it may be determined, for example, by the signal adjuster 120, that the motion sensor 240 experiences higher temperatures than the sensor devices 220 and 230 during daylight hours. This may indicate that the motion sensor 240 is in direct sunlight. A model of the room 500 may include the relative location of the emotion sensor 240 and the window 540, and may also be used to determine that the motion sensor 240 is subject to direct sunlight. It may be determined, for example, by the sensor adjuster 120, that the sensitivity of the motion sensor 210 should be lowered to prevent false alerts. The lowering of the sensitivities of the motion sensors 210 and 240 may be temporary, and may be reversed, for example, when the vent 530 is not on or there is no sunlight, causing the temperatures at the motion sensors 210 and 240 to be similar to the temperature in the rest of the room 500 as detected by the sensors 220 and 230.

At 806, the adjustments may be sent to the motion sensor. For example, the hub computing device 100 may send adjustments determined by the sensor adjuster 120 to the motion sensors 210 and 240. The adjustments may be implemented on the motion sensors 210 and 240, for example, by the signal processors 216 and 246, in order to prevent false alerts caused by being located near a heat source. A notification may also be sent to an occupant of the environment indicating that the motion sensors 210 and 240 may need to be moved in order to ensure optimal performance.

Figure 9:
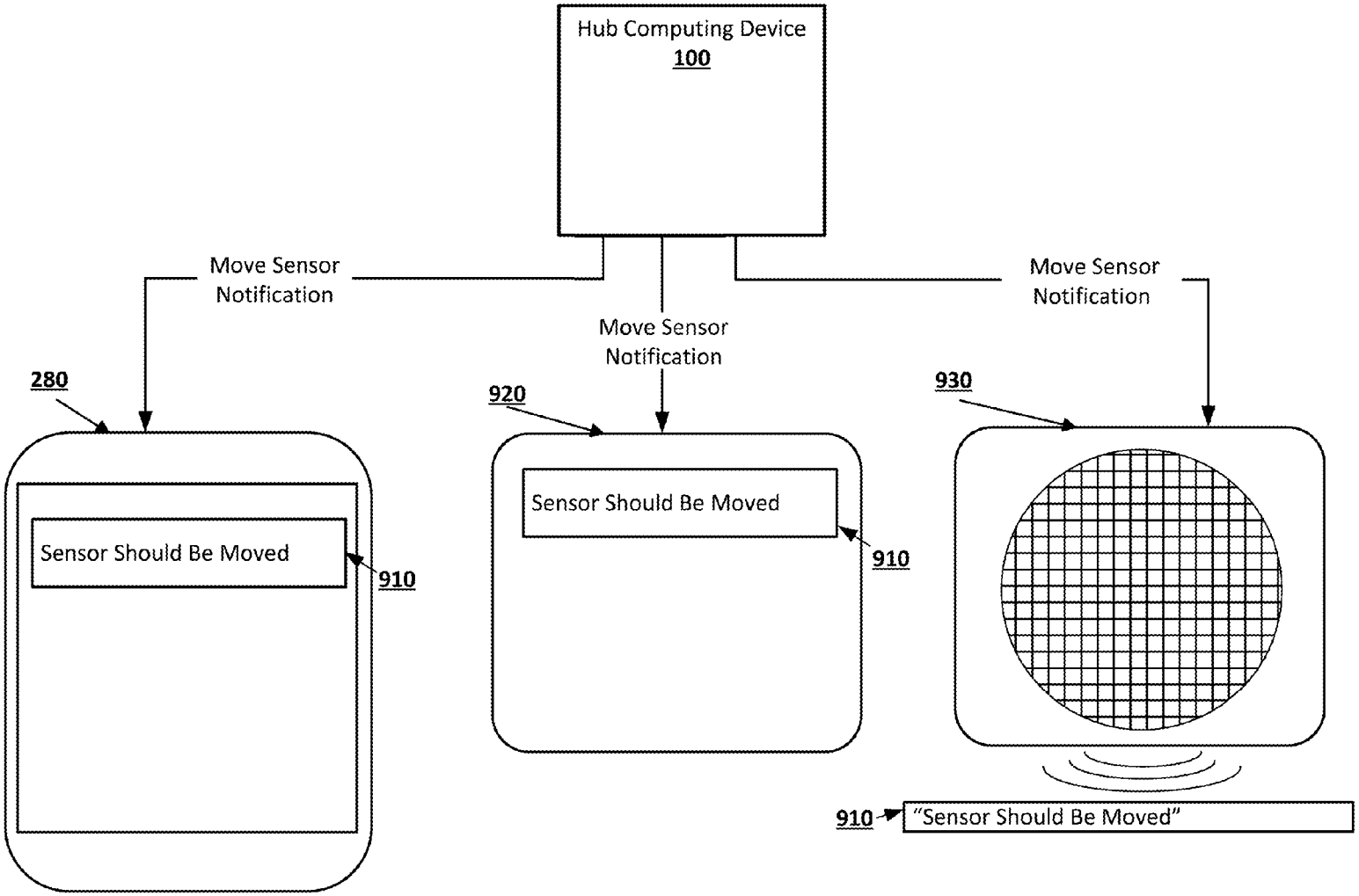
FIG. 9 shows an example arrangement suitable for motion sensor adjustment according to an implementation of the disclosed subject matter.

FIG. 9 shows an example arrangement suitable for motion sensor adjustment according to an implementation of the disclosed subject matter. The signal receiver 110 may send a sensor position report to a user of the security system in any suitable manner. For example, a sensor position report may be sent to the display of the user computing device 280, a display 920 of the hub computing device 100 or other computing device within the smart home environment, or to a speaker 930 within the smart home environment. The sensor position report may be sent any number of displays or speakers, which may be chosen, for example, based on their proximity to the user the notification is sent to. For example, if the user is currently an occupant of the environment and is near the speaker 930, the speaker 930 may be used to communicate the sensor position report to the user. If the user is absent from the environment, the sensor position report may be sent to the user computing device 280, which may be, for example, the user's smartphone. The sensor position report may include, for example, a notification 910, which may explain in written form or verbally the issue with the position of a motion sensor, that an object has been moved, or that a tripwire has been tripped.

Embodiments disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. In some cases, a sensor may operate as multiple sensor types sequentially or concurrently, such as where a temperature sensor is used to detect a change in temperature, as well as the presence of a person or animal.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

Figure 10:
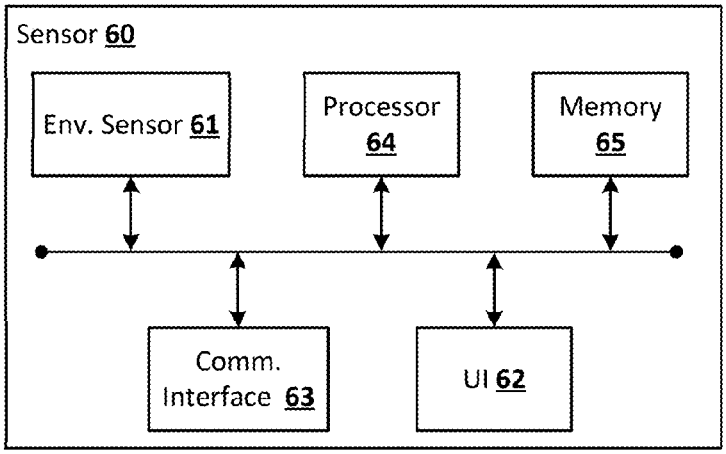
FIG. 10 shows a computing device according to an embodiment of the disclosed subject matter.

A sensor may include hardware in addition to the specific physical sensor that obtains information about the environment. FIG. 10 shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like may allow for communication by the sensor 60 with other devices. A user interface (UI) 62 may provide information and/or receive input from a user of the sensor. The UI 62 may include, for example, a speaker to output an audible alarm when an event is detected by the sensor 60. Alternatively, or in addition, the UI 62 may include a light to be activated when an event is detected by the sensor 60. The user interface may be relatively minimal, such as a limited-output display, or it may be a full-featured interface such as a touchscreen. Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Sensors as disclosed herein may operate within a communication network, such as a conventional wireless network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 11:
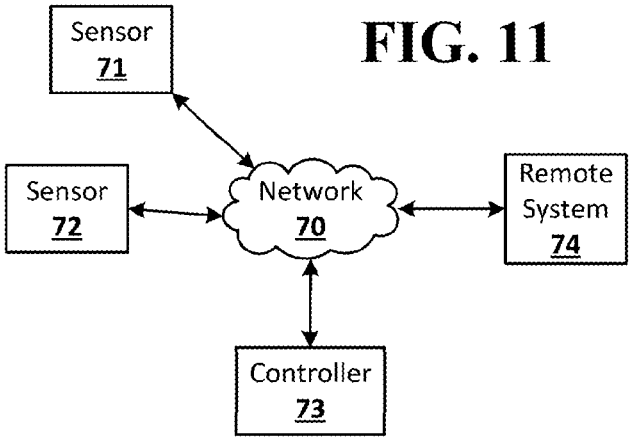
FIG. 11 shows a system according to an embodiment of the disclosed subject matter.

FIG. 11 shows an example of a sensor network as disclosed herein, which may be implemented over any suitable wired and/or wireless communication networks. One or more sensors 71, 72 may communicate via a local network 70, such as a Wi-Fi or other suitable network, with each other and/or with a controller 73. The controller may be a general- or special-purpose computer. The controller may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors may communicate directly with a remote system 74. The remote system 74 may, for example, aggregate data from multiple locations, provide instruction, software updates, and/or aggregated data to a controller 73 and/or sensors 71, 72.

For example, the hub computing device 100, the motion sensors 210, 240, and 910, the sensor devices 220 and 230, and the photodiode devices 920 and 925, may be examples of a controller 73 and sensors 71 and 72, as shown and described in further detail with respect to FIGS. 1-8.

The devices of the security system and smart-home environment of the disclosed subject matter may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail so as to prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 200, 200, or more devices) into a single network supporting multiple hops (e.g., so as to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.20.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The sensor network shown in FIG. 11 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 11 may include a plurality of devices, including intelligent, multi-sensing, network-connected devices that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 11.

According to embodiments of the disclosed subject matter, the smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 11, and the controller 73 may control the HVAC system (not shown) of the structure.

A smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 11, and the controller 73 may control an alarm system to provide a visual and/or audible alarm to the user of the smart-home environment.

A smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 11 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be the sensors 71, 72 shown in FIG. 11. The smart wall switches may detect ambient lighting conditions, and control a power and/or dim state of one or more lights. For example, the sensors 71, 72, may detect the ambient lighting conditions, and the controller 73 may control the power to one or more lights (not shown) in the smart-home environment. The smart wall switches may also control a power state or speed of a fan, such as a ceiling fan. For example, sensors 72, 72 may detect the power and/or speed of a fan, and the controller 73 may adjusting the power and/or speed of the fan, accordingly. The smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, the smart-home environment may include one or more intelligent, multi-sensing, network-connected entry detectors (e.g., "smart entry detectors"). The sensors 71, 72 shown in FIG. 11 may be the smart entry detectors. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed.

The smart-home environment of the sensor network shown in FIG. 11 can include one or more intelligent, multi-sensing, network-connected doorknobs (e.g., "smart doorknob"). For example, the sensors 71, 72 may be coupled to a doorknob of a door (e.g., doorknobs 172 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of the smart-home environment (e.g., as illustrated as sensors 71, 72 of FIG. 11 can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment "learns" who is a user (e.g., an authorized user) and permits the electronic devices associated with those individuals to control the network-connected smart devices of the smart-home environment (e.g., devices communicatively coupled to the network 70). Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

The smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event, any of the network-connected smart devices, such as smart wall plugs located outdoors, detect movement at night time, the controller 73 and/or remote system 74 can activate the outdoor lighting system and/or other lights in the smart-home environment.

Figure 12:
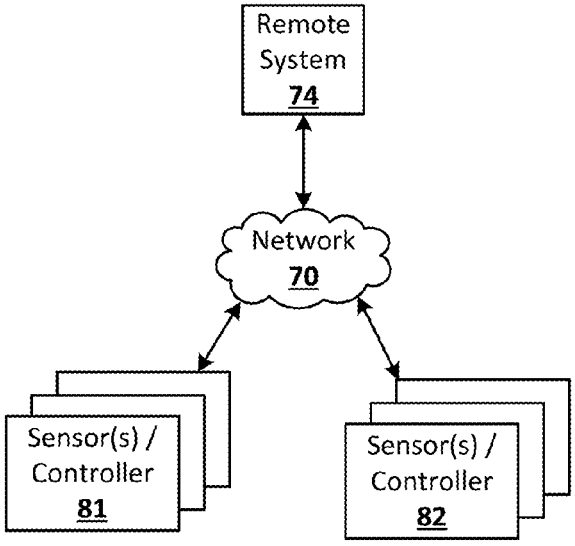
FIG. 12 shows a system according to an embodiment of the disclosed subject matter.

In some configurations, a remote system 74 may aggregate data from multiple locations, such as multiple buildings, multi-resident buildings, individual residences within a neighborhood, multiple neighborhoods, and the like. In general, multiple sensor/controller systems 81, 82 as previously described with respect to FIG. 12 may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. Thus, the user may have control over how information is collected about the user and used by a system as disclosed herein.

Figure 13:
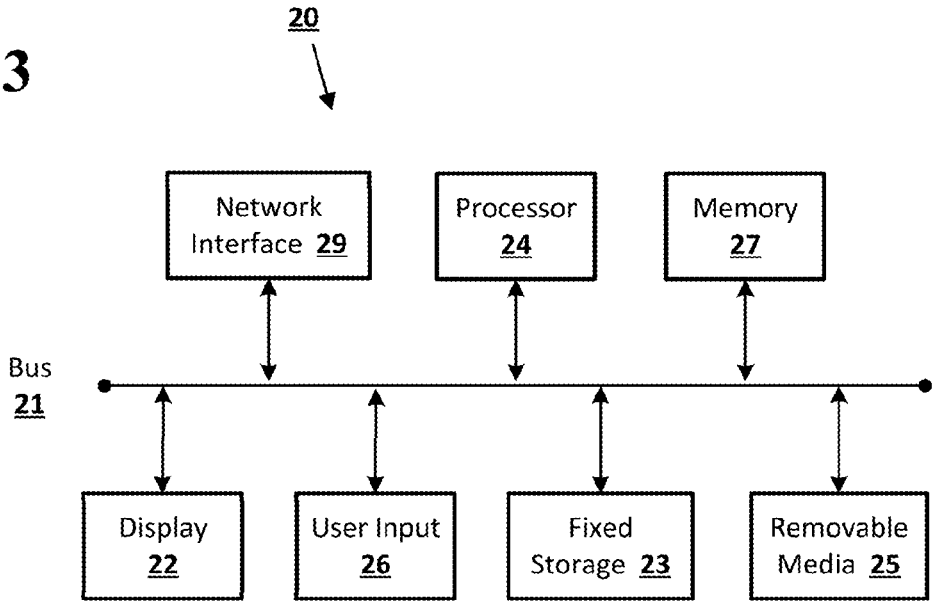
FIG. 13 shows a computer according to an embodiment of the disclosed subject matter.

Embodiments of the presently disclosed subject matter may be implemented in and used with a variety of computing devices. FIG. 13 is an example computing device 20 suitable for implementing embodiments of the presently disclosed subject matter. For example, the device 20 may be used to implement a controller, a device including sensors as disclosed herein, or the like. Alternatively or in addition, the device 20 may be, for example, a desktop or laptop computer, or a mobile computing device such as a smart phone, tablet, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen, a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide such connection using any suitable technique and protocol as will be readily understood by one of skill in the art, including digital cellular telephone, WiFi, Bluetooth®, near-field, and the like. For example, the network interface 29 may allow the device to communicate with other computers via one or more local, wide-area, or other communication networks, as described in further detail herein.

Figure 14:
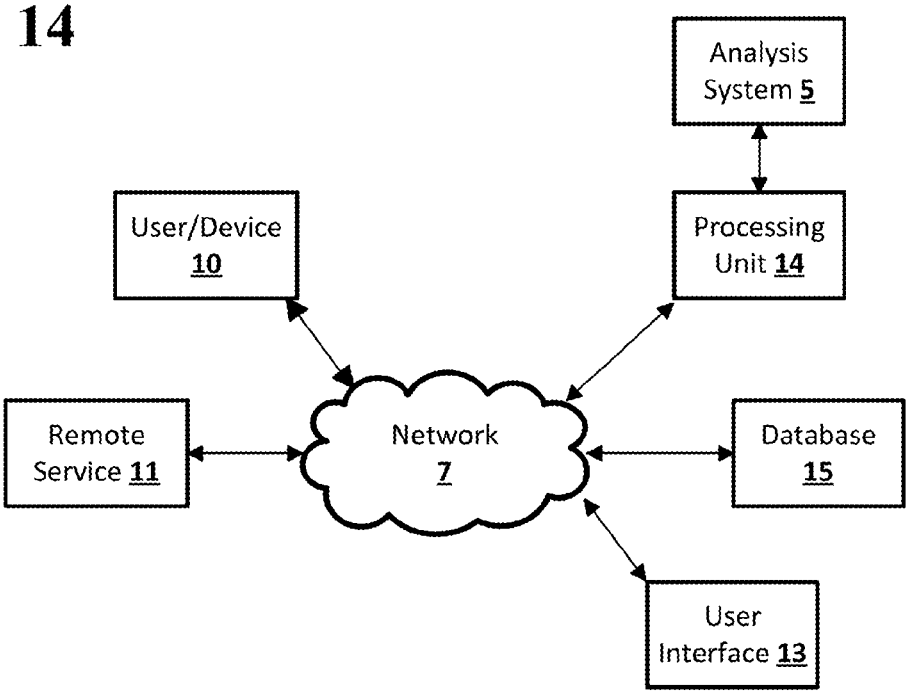
FIG. 14 shows a network configuration according to an embodiment of the disclosed subject matter.

FIG. 14 shows an example network arrangement according to an embodiment of the disclosed subject matter. One or more devices 10, 16, such as local computers, smart phones, tablet computing devices, and the like may connect to other devices via one or more networks 7. Each device may be a computing device as previously described. The network may be a local network, wide-area network, the Internet, or any other suitable communication network or networks, and may be implemented on any suitable platform including wired and/or wireless networks. The devices may communicate with one or more remote devices, such as servers 18 and/or databases 20. The remote devices may be directly accessible by the devices 10, 16, or one or more other devices may provide intermediary access such as where a server 18 provides access to resources stored in a database 20. The devices 10, 16 also may access remote platforms 17 or services provided by remote platforms 17 such as cloud computing arrangements and services. The remote platform 17 may include one or more servers 18 and/or databases 20.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A computer-implemented method performed by a data processing apparatus, the method comprising:

receiving a signal indicating that a moving heat source was detected by a passive infrared sensor;

receiving a signal comprising a current temperature determined by a temperature sensor separate from the passive infrared sensor;

determining, based on the current temperature and at least one previous temperature that an area in proximity to the passive infrared sensor has experienced a temperature change;

in response to the determination that the area in proximity to the passive infrared sensor has experienced a temperature change, disregarding the signal indicating that a moving heat source was detected by the passive infrared sensor as a false alert and not sending an indication of motion detected;

receiving another signal indicating that a moving heat source was detected by the passive infrared sensor;

receiving a signal comprising a second current temperature;

determining, based on the second current temperature and at least one previous temperature that an area in proximity to the passive infrared sensor has not experienced a temperature change; and in response to the determination that the area in proximity to the passive infrared sensor has not experienced a temperature change, sending an indication of motion detected.

2. The computer-implemented method of claim 1, further comprising:

in response to disregarding the signal indicating that a moving heat source was detected by a passive infrared sensor as a false alert, determining an adjustment for the passive infrared sensor; and applying the adjustment to the passive infrared sensor.

3. The computer-implemented method of claim 1, wherein the adjustment comprises a reduction in the sensitivity of the passive infrared sensor to moving heat sources.

4. The computer-implemented method of claim 1, wherein the indication of motion detected is sent to a computing device of a smart home environment.

5. The computer-implemented method of claim 1, wherein determining, based on the current temperature and at least one previous temperature that an area in proximity to the passive infrared sensor has experienced a temperature change comprises determining that the temperature in the area in proximity to the passive infrared sensor has fluctuated beyond a threshold amount during a time period.

6. The computer-implemented method of claim 5, wherein the time period begins before receiving the signal indicating a moving heat source was detected by the passive infrared sensor and ends after receiving the signal indicating a moving heat source was detected by the passive infrared sensor.

7. A computer-implemented method performed by a data processing apparatus, the method comprising:

receiving a signal comprising a current temperature near a motion sensor wherein the motion sensor comprises a passive infrared sensor and wherein the current temperature near the motion sensor is determined by a first temperature sensor that is separate from the passive infrared sensor;

receiving at least one signal comprising a current temperature near a second temperature sensor in the same room as the motion sensor;

determining an adjustment for the motion sensor based on the current temperature determined by the first temperature sensor being higher than a past temperature that was determined by the first temperature sensor by more than a threshold amount, and on the current temperature near the second temperature sensor not being higher than a past temperature near the second temperature sensor by more than the threshold amount; and sending the adjustment to the motion sensor.

8. The computer-implemented method of claim 7, wherein determining the adjustment further comprises:

determining that the temperature near the motion sensor varies from the temperature near at least one temperature sensor over a time period.

9. The computer-implemented method of claim 8, further comprising:

receiving an HVAC status;

determining from the HVAC status that the ambient temperature near the motion sensor is higher than the ambient temperature near at least one temperature sensor over a time period coinciding with a time period when a vent in the room with the motion sensor is operating to convey hot air.

10. The computer-implemented method of claim 9, further comprising determining that the vent is located near the motion sensor.

11. The computer-implemented method of claim 8, further comprising determining that the temperature near the motion sensor is higher than the temperature near at least one temperature sensor over a time period coinciding with at least a part of daylight hours.

12. The computer-implemented method of claim 11, further comprising determining that the motion sensor is located near a window.

13. The computer-implemented method of claim 7, further comprising transmitting an alert that the motion sensor is located near a heat source.

14. A computer-implemented system for motion sensor adjustment comprising:

a temperature sensor adapted to detect a temperature;

a passive infrared sensor adapted to detect motion of a heat source; and a signal processor adapted to receive a signal indicating that a moving heat source was detected by the passive infrared sensor, receive a signal comprising a current temperature detected by the temperature sensor; determine, based on the current temperature and at least one previous ambient temperature that an area monitored by the passive infrared sensor has experienced an environmental temperature change, in response to the determination that the area in proximity to the passive infrared sensor has experienced an environmental temperature change determine that the signal from the passive infrared sensor indicates a change in environmental temperature and not a motion of an object, receive another signal indicating that a moving heat source was detected by the passive infrared sensor, receive a signal comprising a second current temperature, determine, based on the second current temperature and at least one previous temperature that an area in proximity to the passive infrared sensor has not experienced a temperature change, and in response to the determination that the area in proximity to the passive infrared sensor has not experienced a temperature change, send an indication of motion detected, wherein the temperature sensor is separate from the passive infrared sensor.

15. The computer-implemented system of claim 14, wherein the temperature sensor is located in or near a heating duct.

16. The computer-implemented system of claim 14, wherein the temperature sensor is located at or near a radiator for heating a room.

17. The computer-implemented system of claim 14, wherein the temperature sensor is located at or near an environmental heater for raising the ambient temperature of a room.

18. The computer-implemented system of claim 14, wherein the signal processor is further adapted to determine an adjustment for the passive infrared sensor based on a discarding of the signal indicating that a moving heat source was detected by a passive infrared sensor as a false alert, and apply the adjustment to the passive infrared sensor.

19. A computer-implemented system for motion sensor adjustment comprising a motion sensor comprising a passive infrared sensor, the motion sensor located in a room;

a first temperature sensor that is a component of or co-located with the motion sensor and is separate from the passive infrared sensor;

a second temperature sensor located in the room; and a hub computing device adapted to receive a signal comprising a current ambient temperature near the motion sensor from the first temperature sensor, receive a signal comprising a current ambient temperature near the second temperature sensor, determine an adjustment for the motion sensor based on the current ambient temperature near the motion sensor from the first temperature sensor being higher by more than a threshold amount than a past ambient temperature near the motion sensor that was determined by the first temperature sensor, and on the current ambient temperature near the second temperature sensor not being higher by more than threshold amount than a past ambient temperature near the second temperature sensor, and send the adjustment to the motion sensor.

20. The computer-implemented system of claim 19, wherein the hub computing device is further adapted to receive an HVAC status and determine from the HVAC status that the ambient temperature near the motion sensor is higher than the ambient temperature near the at least one additional temperature sensor over a time period coinciding with a time period when a vent in the room with the motion sensor is operating to pump hot air.

21. The computer-implemented system of claim 19, wherein the hub computing device is further adapted to determine that the ambient temperature near the motion sensor is higher than the ambient temperature near the least one additional temperature sensor over a time period coinciding with at least a part of daylight hours.

22. The computer-implemented system of claim 19, wherein the hub computing device is further adapted to transmit an alert that the motion sensor is located near a heat source.

23. A system comprising: one or more computers and one or more non-transitory storage devices storing instructions which are operable, when executed by the one or more computers, to cause the one or more computers to perform operations comprising:

receiving a signal indicating that a moving heat source was detected by a passive infrared sensor;

receiving a signal comprising a current temperature determined by a temperature sensor separate from the passive infrared sensor;

determining, based on the current temperature and at least one previous temperature that an area in proximity to the passive infrared sensor has experienced a temperature change;

in response to the determination that the area in proximity to the passive infrared sensor has experienced a temperature change, disregarding the signal indicating that a moving heat source was detected by the passive infrared sensor as a false alert and not sending an indication of motion detected;

receiving another signal indicating that a moving heat source was detected by the passive infrared sensor;

receiving a signal comprising a second current temperature;

determining, based on the second current temperature and at least one previous temperature that an area in proximity to the passive infrared sensor has not experienced a temperature change; and in response to the determination that the area in proximity to the passive infrared sensor has not experienced a temperature change, sending an indication of motion detected.

24. A system comprising: one or more computers and one or more non-transitory storage devices storing instructions which are operable, when executed by the one or more computers, to cause the one or more computers to perform operations comprising:

receiving a signal comprising a current temperature near a motion sensor wherein the motion sensor comprises a passive infrared sensor and wherein the current temperature near the motion sensor is determined by a first temperature sensor that is separate from the passive infrared sensor;

receiving at least one signal comprising a current temperature near a second temperature sensor in the same room as the motion sensor;

determining an adjustment for the motion sensor based on the current temperature determined by the first temperature sensor being higher than a past temperature that was determined by the first temperature sensor by more than a threshold amount, and on the current temperature near the second temperature sensor not being higher than a past temperature near the second temperature sensor by more than the threshold amount; and sending the adjustment to the motion sensor.

* * * * *